US008701923B2

(12) United States Patent
Anhalt et al.

(10) Patent No.: US 8,701,923 B2
(45) Date of Patent: Apr. 22, 2014

(54) CONTAINERS WITH ANTI-BUCKLING STRUCTURAL FEATURES

(75) Inventors: Joseph P. Anhalt, Brainerd, MN (US); Robert R. Turvey, Sanford, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 225 days.

(21) Appl. No.: 12/828,162

(22) Filed: Jun. 30, 2010

(65) Prior Publication Data

US 2012/0000920 A1 Jan. 5, 2012

(51) Int. Cl.
*B65D 1/22* (2006.01)
*B65D 1/26* (2006.01)
*B65D 1/44* (2006.01)

(52) U.S. Cl.
CPC ... *B65D 1/22* (2013.01); *B65D 1/26* (2013.01); *B65D 1/44* (2013.01)
USPC ..... 220/475; 220/608; 220/669; 220/670; 220/671; 220/673; 220/675; 220/4.22; 220/315; 220/324; 220/676; 206/557

(58) Field of Classification Search
CPC ..... B65D 1/22; B65D 1/26; B65D 1/34; B65D 1/44
USPC ..... 220/4.22, 315, 324, 475, 608, 669, 670, 220/671, 673, 675, 676; 206/557
See application file for complete search history.

(56) References Cited

U.S. PATENT DOCUMENTS 2,768,667 A * 10/1956 Hill ..... 206/518
3,311,257 A * 3/1967 Puente ..... 206/512
3,326,408 A 6/1967 Ringlen
4,512,493 A * 4/1985 Von Holdt ..... 220/782
5,261,558 A 11/1993 Claydon
5,423,453 A 6/1995 Fritz
D378,039 S * 2/1997 Ferris ..... D7/602
D392,881 S 3/1998 Bulcher et al.
5,758,791 A 6/1998 Mangla
D409,909 S 5/1999 Hayes et al.
D419,442 S 1/2000 McClung et al.
D446,450 S 8/2001 Zettle et al.
D448,288 S 9/2001 Zettle et al.
6,293,458 B1 9/2001 Sarnoff
6,367,630 B1 * 4/2002 Elskamp ..... 206/508
6,398,062 B1 6/2002 Jones
D468,202 S 1/2003 Chou
6,666,348 B2 * 12/2003 Fore et al. ..... 220/4.21
6,786,351 B2 9/2004 Krueger
7,243,813 B2 7/2007 Krueger
D570,681 S 6/2008 Hussain et al.
2006/0138152 A1 6/2006 Pelletier et al.
2008/0023364 A1 1/2008 Krueger
2009/0134179 A1 5/2009 Kidd et al.
2009/0223966 A1 9/2009 Kidd et al.

* cited by examiner

*Primary Examiner* — Fenn Mathew
*Assistant Examiner* — Elizabeth Volz

(57) ABSTRACT

This disclosure is generally directed toward containers with improved anti-buckling performance by incorporating one or more structural reinforcement features into the containers. The container may include a bottom wall, opposing sidewalls each including a plurality of ribs, and opposing end walls interconnecting the sidewalls. The sidewalls may include at least one reinforcement protrusion having a geometric center disposed in the upper half of the sidewall. The container may also include a non-planar top rim to redistribute top load so that the anti-buckling performance of the container can be improved.

18 Claims, 9 Drawing Sheets

CONTAINERS WITH ANTI-BUCKLING STRUCTURAL FEATURES

BACKGROUND

1. Technical Field

This disclosure generally relates to containers and more particularly to containers having structural reinforcements.

2. Description of the Related Art

Plastic containers for storage and/or transportation purposes are well known in the art. For example, commercially available containers may be manufactured from thermoplastic materials such as polyolefins and polyesters. Common thermoplastic container materials include polypropylene (PP) and polyethylene terephthalate (PET). While conventionally formed as reusable, non-transparent containers with relatively thick sidewalls, durable, recyclable, and disposable plastic containers with translucent and thinner sidewalls have been developed to reduce manufacturing costs and environmental impact.

When heavier items are stored in and/or transported by the container, the container may be under one or more type of stress or load, such as on the top lid, top rim, walls, and/or bottom of the container. In particular, when the load exceeds a threshold value, the container may collapse or buckle at certain area(s) of weakness, causing damage to the items and surrounding environment. In some cases, collapsed or buckled containers containing hazardous materials, such as hot fluid, caustic or toxic materials, and sharp objects, can lead to serious personal injury.

One way to address this issue is to incorporate structural features into the container to improve its anti-buckling strength and/or structural rigidity. In particular, it has been found that the structural rigidity of the container may be reinforced by providing a plurality of ribs formed on the walls thereof. In some cases, the ribs may be provided throughout the walls of the container. Alternatively, the ribs may be provided only on some portions of the walls, leaving other portions of the walls rib-less.

While providing anti-buckling ribs benefits some containers, other containers may have different zones of weakness that the ribs may be inadequate to reinforce. For example, during the thermoforming process of the container, some portions of the container walls may be thinner than other portions. Moreover, zones of weakness may also depend on the overall shape and structure of the container.

SUMMARY OF THE DISCLOSURE

Containers with improved anti-buckling performance are disclosed herein. The containers may have structural reinforcement features that are positioned and configured to improve the container's anti-buckling resistance. In one exemplary embodiment, the container may include a bottom wall, opposing sidewalls each including a plurality of ribs, and opposing end walls interconnecting the sidewalls. The sidewalls may include at least one reinforcement protrusion disposed thereon. The reinforcement protrusion may have a geometric center disposed in the upper half of the sidewall.

In another exemplary embodiment, the container may include a bottom wall, opposing sidewalls each upwardly extending from the bottom wall and terminating in a side edge, and opposing end walls each upwardly extending from the bottom wall and terminating into an end edge. The side edges may be non-planar.

In yet another exemplary embodiment, the container may include a bottom wall and a continuous container wall upwardly extending from the bottom wall and terminating in a top rim. The container wall may include a plurality of ribs and at least one reinforcement protrusion having a geometric center disposed on the upper half of the container wall. The top rim of the container wall may be non-planar.

In this disclosure, the terms "longer" and "shorter" used to describe the relative length of the various portions of the containers should not be understood as referring to any de minimis length variations that are typically present as ordinary imperfections in graphic illustration or in production of the containers. Further, when referring to the edges, the terms "planar" and "non-planar" used in this disclosure should be interpreted as indicating the relationship between the edges, i.e. whether or not the edges lie within the same plane, rather than indicating the geometric characteristic of each individual edge.

Other features of the disclosed containers will be described in greater detail below. It will also be noted here and elsewhere that the containers disclosed herein may be suitably modified to be used in a wide variety of applications by one of ordinary skill in the art without undue experimentation.

BRIEF DESCRIPTION OF THE DRAWINGS

For a more complete understanding of the disclosed container, reference should be made to the exemplary embodiments illustrated in greater detail in the accompanying drawings, wherein.

It should be understood that the drawings are not necessarily to scale and that the disclosed exemplary embodiments are sometimes illustrated diagrammatically and in partial views. In certain instances, details which are not necessary for an understanding of the disclosed containers which render other details difficult to perceive may have been omitted. It should be understood, of course, that this disclosure is not limited to the particular exemplary embodiments illustrated herein.

DETAILED DESCRIPTION OF THE DISCLOSURE

This disclosure is generally directed toward containers with improved anti-buckling performance by reinforcing weaker portions of the container and/or by shifting load from weaker portions of the container to stronger portions of same. It is to be understood that the disclosed containers may be transparent, translucent, opaque, or non-transparent and may be colored or colorless.

Figure 1:
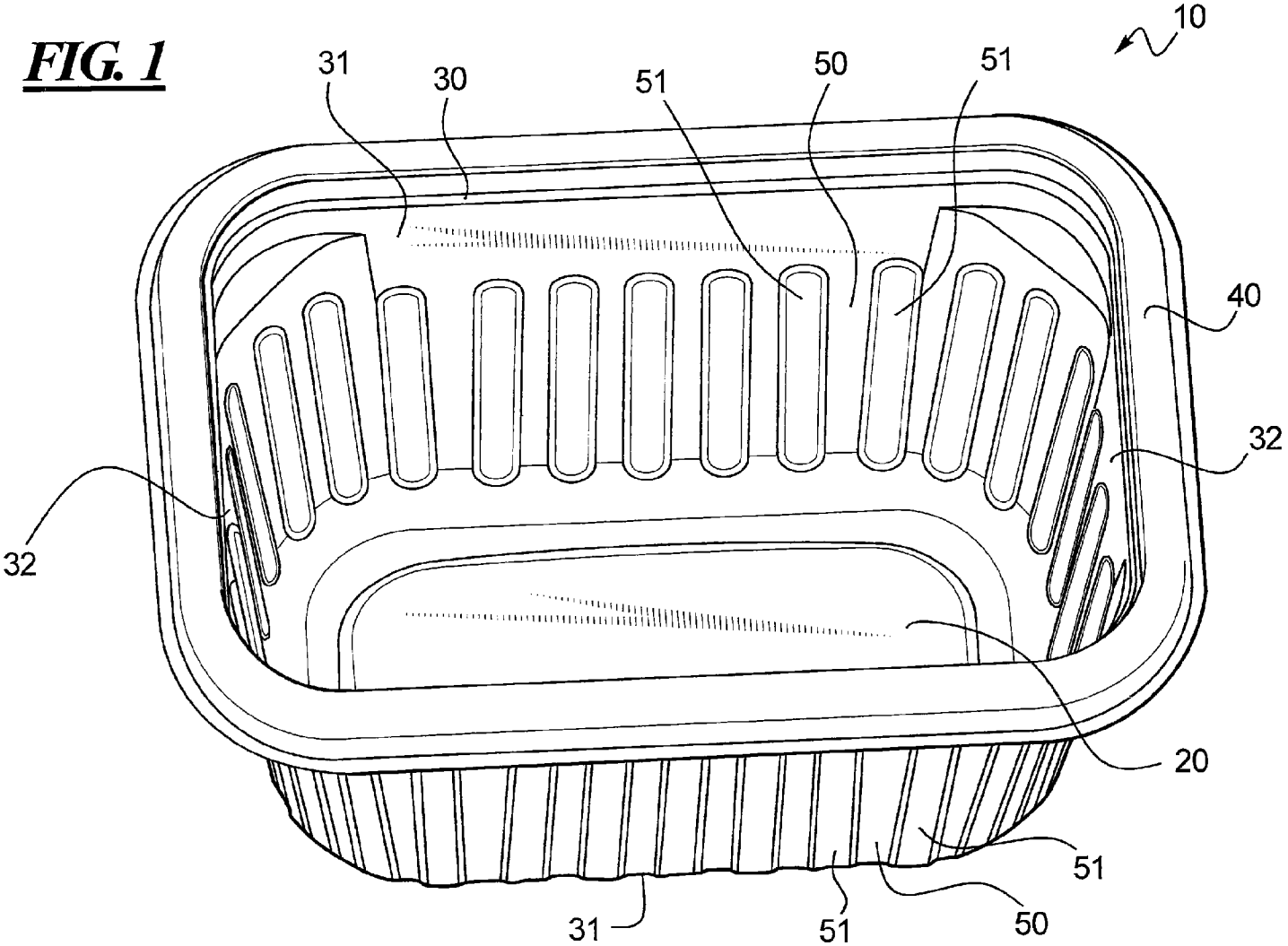
FIG. 1 is a top perspective view of a container with ribbed walls.

Turning to FIG. 1, a substantially rectangular container 10 is illustrated as having a bottom wall 20, a continuous container wall 30 upwardly extending from the periphery of the bottom wall 20 and terminating into a flat top rim 40. The container wall 30 includes two opposing side walls 31 and two opposing end walls 32 interconnecting the sidewalls 31. The sidewalls 31 are horizontally longer than the end walls 32. A plurality of ribs 50 is formed on the container wall 30 to improve its structural rigidity. Each of the ribs 50 is defined by two adjacent grooves 51 provided on the container wall 30. As illustrated in FIG. 1, the ribs 50 and grooves 51 upwardly terminate below the top rim 40.

The process used to form the container 10 may result in the wall 30 having a non-uniform thickness profile. For example, although the top 90% of the container wall 30 may have a relatively uniform thickness (e.g. 0.1905 mm), the wall thickness may gradually increase in the bottom 10% of the container wall (e.g. 0.1905 mm→0.238 mm→0.285 mm→0.333 mm→0.381 mm). The transition in thickness may be even or smooth in some examples and uneven or stepped in other examples. Without wishing to be bound by any particular theory, it is contemplated that by reinforcing the upper portion of the sidewalls 31 and/or by shifting some of the load on the sidewalls 31 to the horizontally shorter end walls 32, the load resistance and anti-buckling performance of the container 10 may be improved.

To that end, a container 100 according to one exemplary embodiment of this disclosure is illustrated in FIGS. 2-5. The container 100 includes a bottom wall 120, a continuous container wall 130 upwardly and outwardly extending from the periphery of the bottom wall 120 and terminating in a planar top rim 140. The container wall 130 includes two opposing sidewalls 131 and two opposing end walls 132 interconnecting the sidewalls 131. Each of the sidewalls 131 extends between an upper end 133 merged with the top rim 140, and a lower end 134 merged with the bottom wall 120. As the container 100 in this exemplary embodiment is substantially rectangular, the sidewalls 131 are horizontally longer than the end walls 132. However, it is to be understood that the shape of the container is not to be limited to the exemplary embodiments disclosed herein and the container may have other shapes such as square, elliptical, etc. in view of this disclosure.

Figure 4:
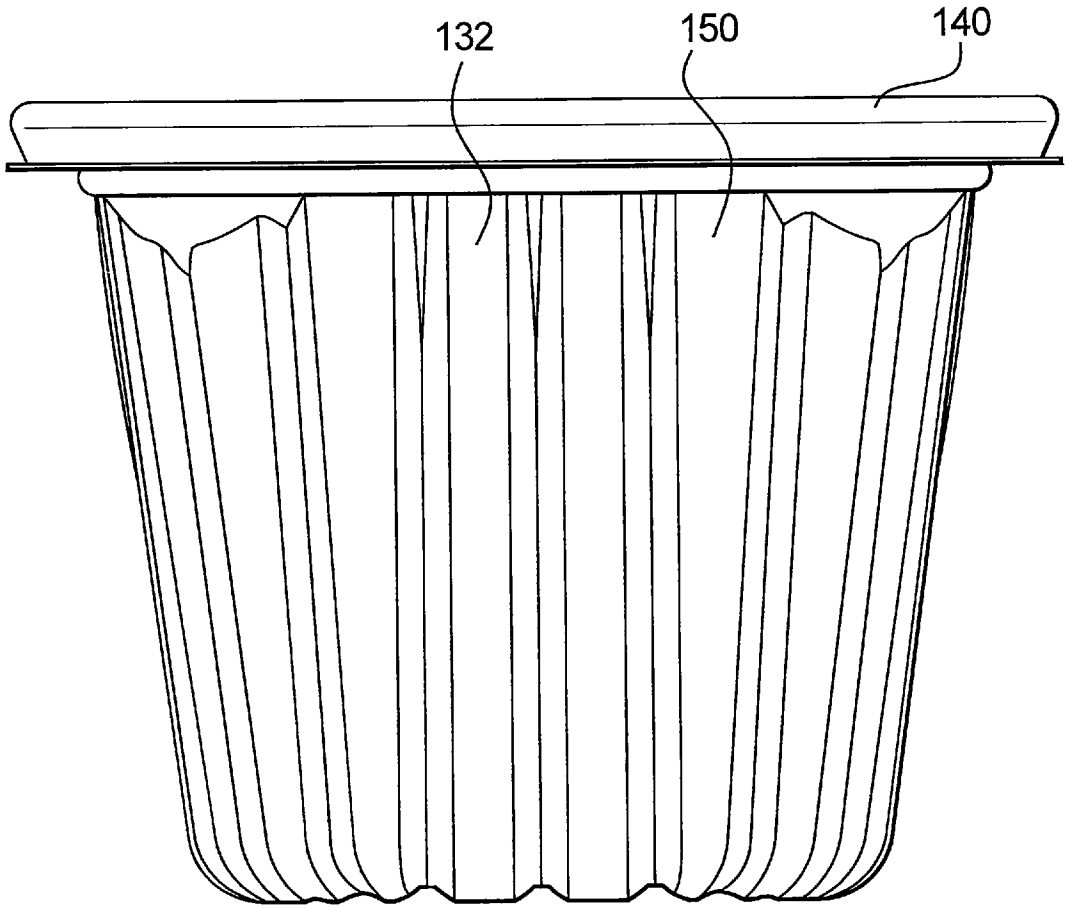
FIG. 4 is a front end view of the container shown in FIGS. 2-3.
Figure 5:
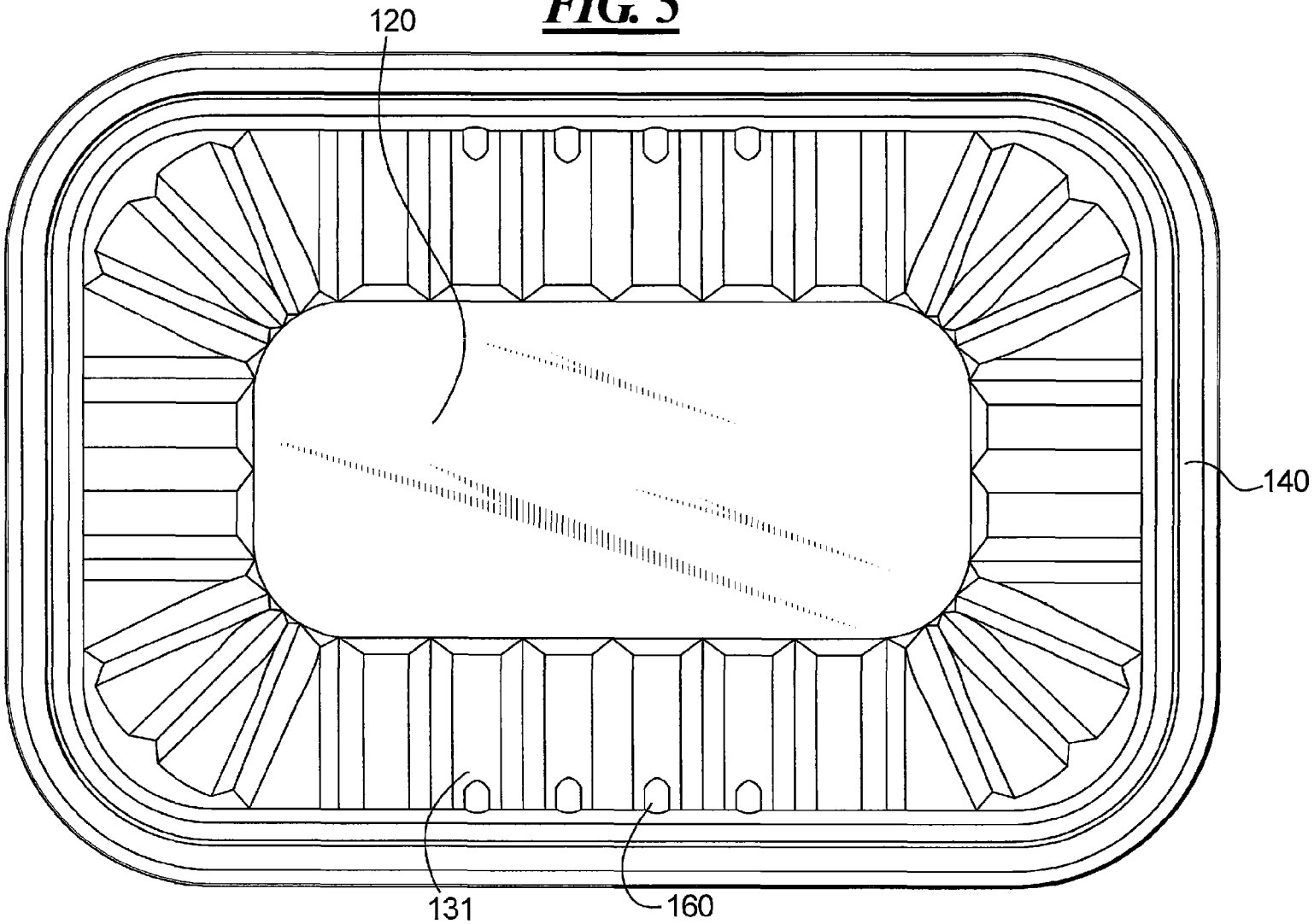
FIG. 5 is a top view of the container shown in FIGS. 2-4.

To improve the structural rigidity of the container 100, each of the sidewalls 131 includes a plurality of ribs 150 extending between its upper and lower ends (133, 134). Each of the ribs 150 is defined by two adjacent grooves 151 provided on the sidewalls 131. Unlike the container 10 illustrated in FIG. 1, the ribs 150 and grooves 151 of the container 100 upwardly terminate into the top rim 140. As illustrated in FIG. 4, the end walls 132 may also include a plurality of ribs 150 defined by adjacent grooves 151, both of which terminate into the top rim 140. However, as the end walls 132 may be less susceptible to load-induced deformation and budding, the ribs 150 and grooves 151 on the end walls 132 may be optional in other examples.

Figure 2:
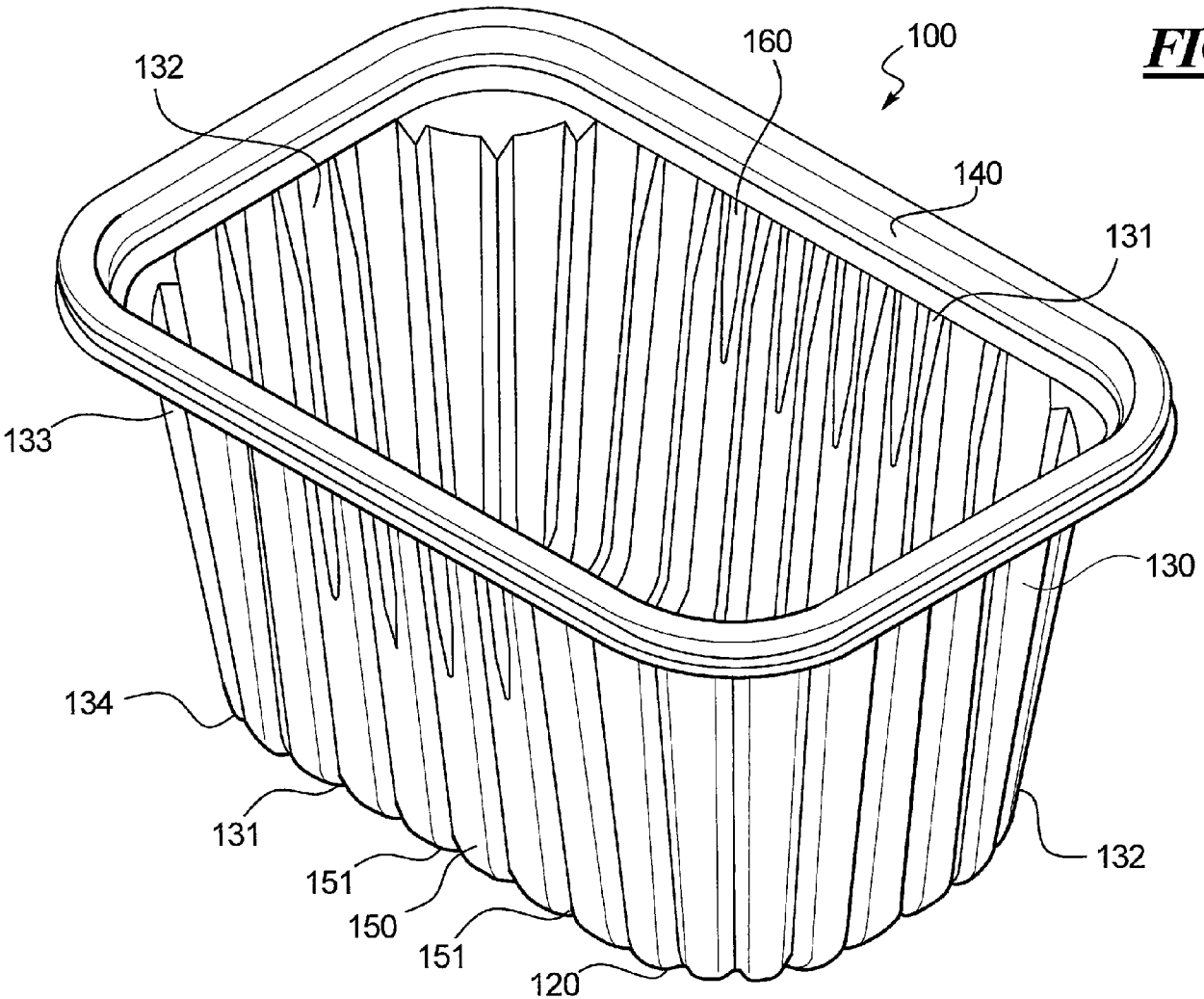
FIG. 2 is a top perspective view of a container according to one exemplary embodiment of this disclosure.
Figure 3:
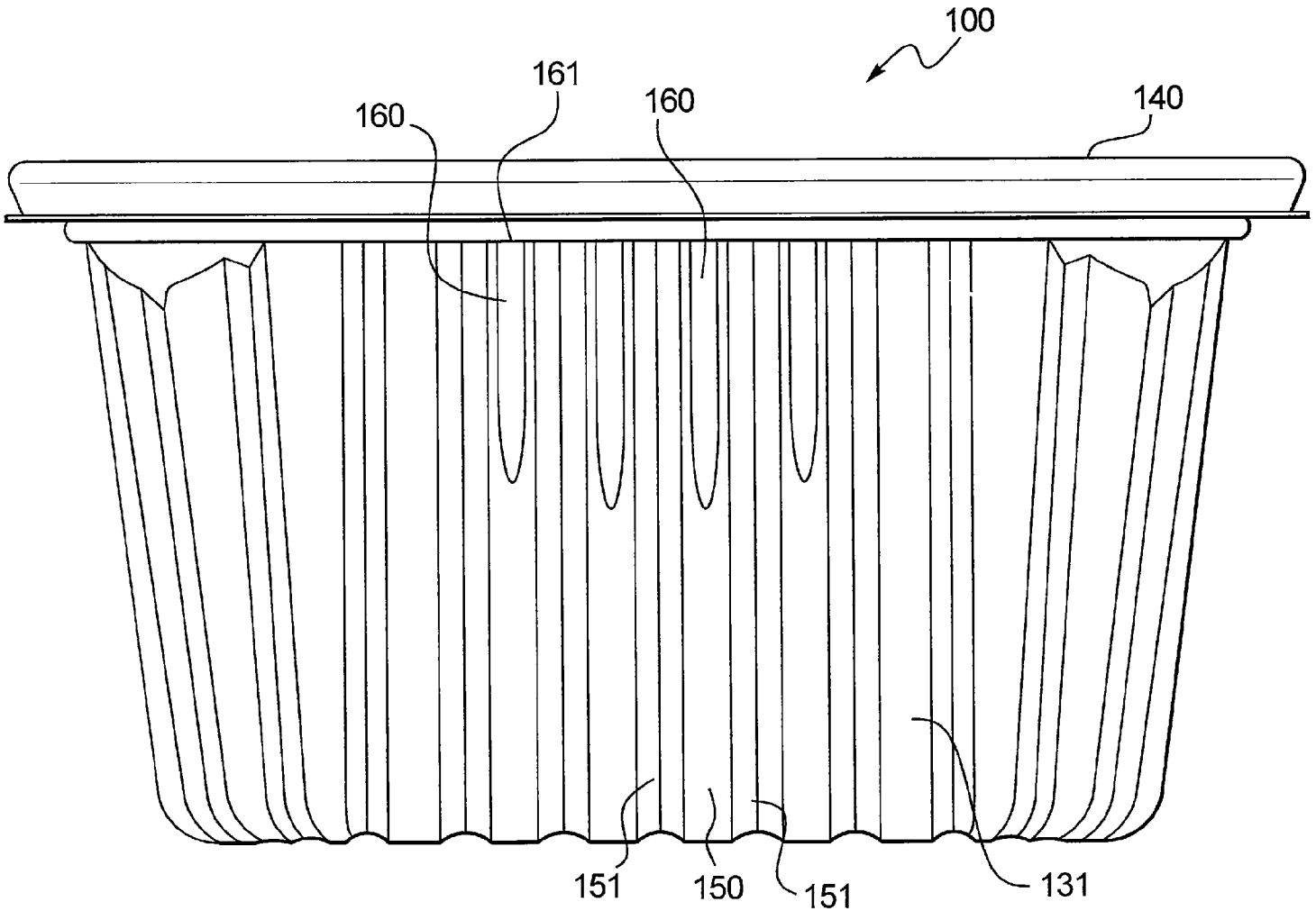
FIG. 3 is a side view of the container shown in FIG. 2, particularly illustrating the reinforcement protrusions on the sidewall of the container.

As illustrated in FIGS. 2-3, the sidewalls 131 may include at least one reinforcement protrusion 160 to further improve the load resistance and anti-buckling performance of the container 100. The protrusion 160 has a geometric center that is disposed on the upper half (i.e. above the horizontal center line) of the sidewall 131. In some non-limiting examples, the entire protrusion 160 may be disposed on the upper half of the sidewall 131. As with the ribs 150 and grooves 151, the protrusion 160 may also upwardly terminate into the top rim 140, although the protrusion 160 may also upwardly terminate below the top rim 140 in other embodiments. The protrusion 160 may be provided on one of the ribs 150 as shown in FIGS. 2-3, or it may be provided on one of the grooves 151 or between the rib 150 and adjacent groove 151 (not shown).

The protrusion 160 may have an elongated triangular shape with its base 161 merged into the top rim 140 of the container 100. Other shapes, however, may also be used in light of this disclosure. For example, the protrusion 160 may be rectangular, diamond-shaped, oval, or other suitable elongated shapes. The protrusion 160 may be narrower than the rib 150, the groove 151, or both, although wider and larger protrusions may also be used in light of this disclosure.

Turning now to FIGS. 6-9, a container 200 according to another exemplary embodiment of this disclosure is illustrated as having a bottom wall 220, a continuous container wall 230 upwardly and outwardly extending from the periphery of the bottom wall 220 and terminating into a non-planar top rim 240. The container wall 230 includes two opposing sidewalls 231 and two opposing end walls 232 interconnecting the sidewalls 231. The top rim 240 includes two opposing side edges 241 and two opposing end edges 242 interconnecting the side edges 241.

As illustrated in FIGS. 6-9, each of the sidewalls 231 extends between an upper end 233 and a lower end 234 and each of the end walls 232 extends between an upper end 235 and a lower end 236. The lower ends (234, 236) merge with the bottom wall 240 and the upper ends (233, 235) merge with the side and end edges (241, 242), respectively. The side edges 241 may be substantially parallel to each other and the end edges 242 may be substantially parallel to each other. As the container 200 in this exemplary embodiment is substantially rectangular, the sidewalls 231 are horizontally longer than the end walls 232. However, it is to be understood that the shape of the container is not to be limited to the exemplary embodiments disclosed herein and the container may have other shapes such as square, elliptical, etc. in view of this disclosure.

As discussed earlier, the load resistance and anti-buckling performance of the container 200 may be improved by shifting some of the load on the sidewalls 231 to the horizontally shorter end walls 232. To that end, the side edges 241 of the top rim may be non-planar while the end edges 242 remain planar. In particular, the side edges 241 may include an upwardly raised center portion 243 to redistribute some of the load from the sidewalls 231 to the end walls 232. Although the side edges 241 are shown in FIGS. 6-9 as having a smooth curved profile, it is to be understood that the side edges 241 may also having an angular or irregular profile so long as such profile facilitates the redistribution of load from the sidewalls 231 to the end walls 232. The end edges 242 may be straight and/or substantially parallel to each other, as shown in FIGS. 6-9. However, this is not to be interpreted as limiting the scope of this disclosure. Specifically, the end edges 242 may be curved, angular or irregular, and they may be substantially parallel or non-parallel to each other, as long as the end edges 242 are planar with each other.

Figure 8:
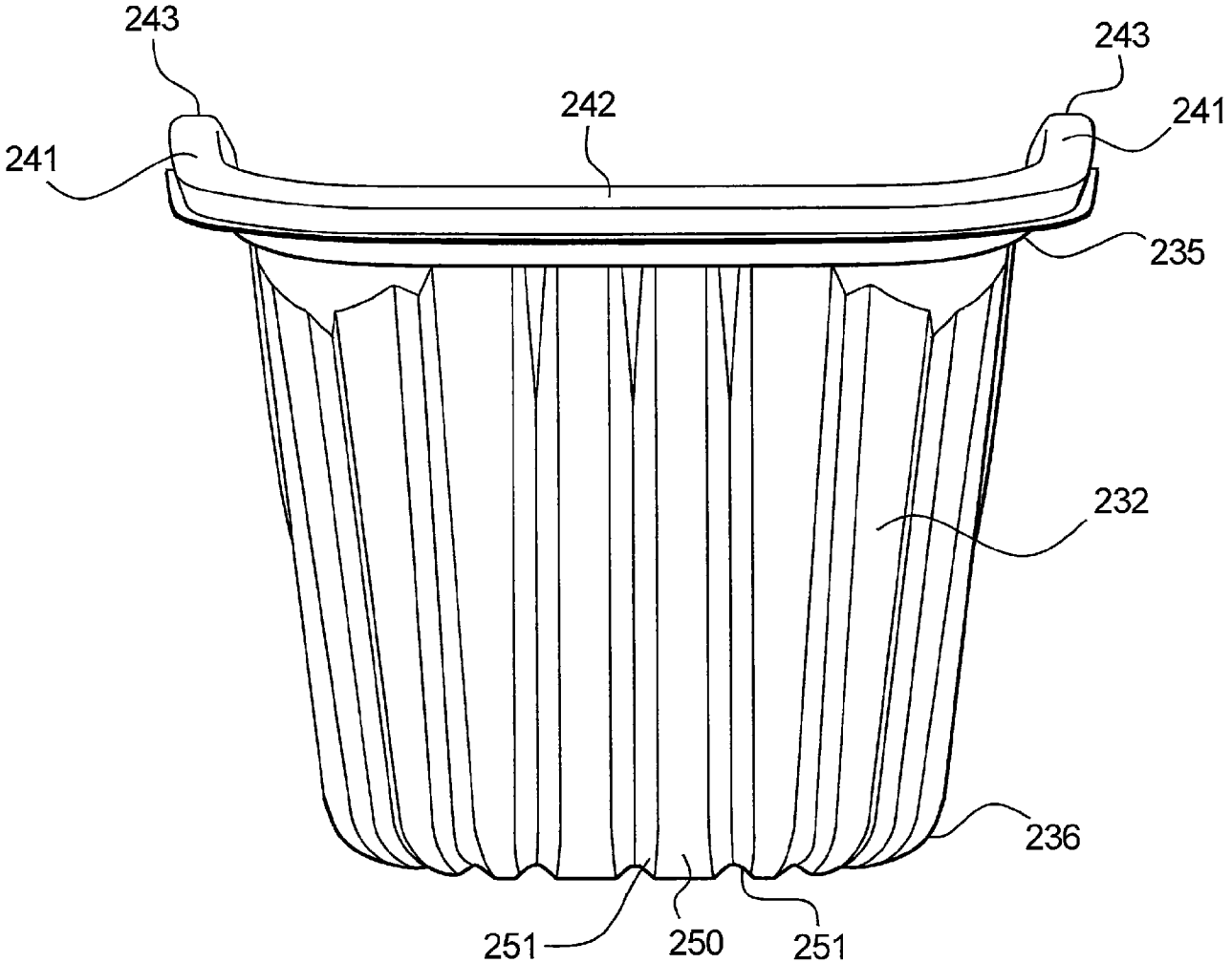
FIG. 8 is a front end view of the container shown in FIGS. 6-7.
Figure 9:
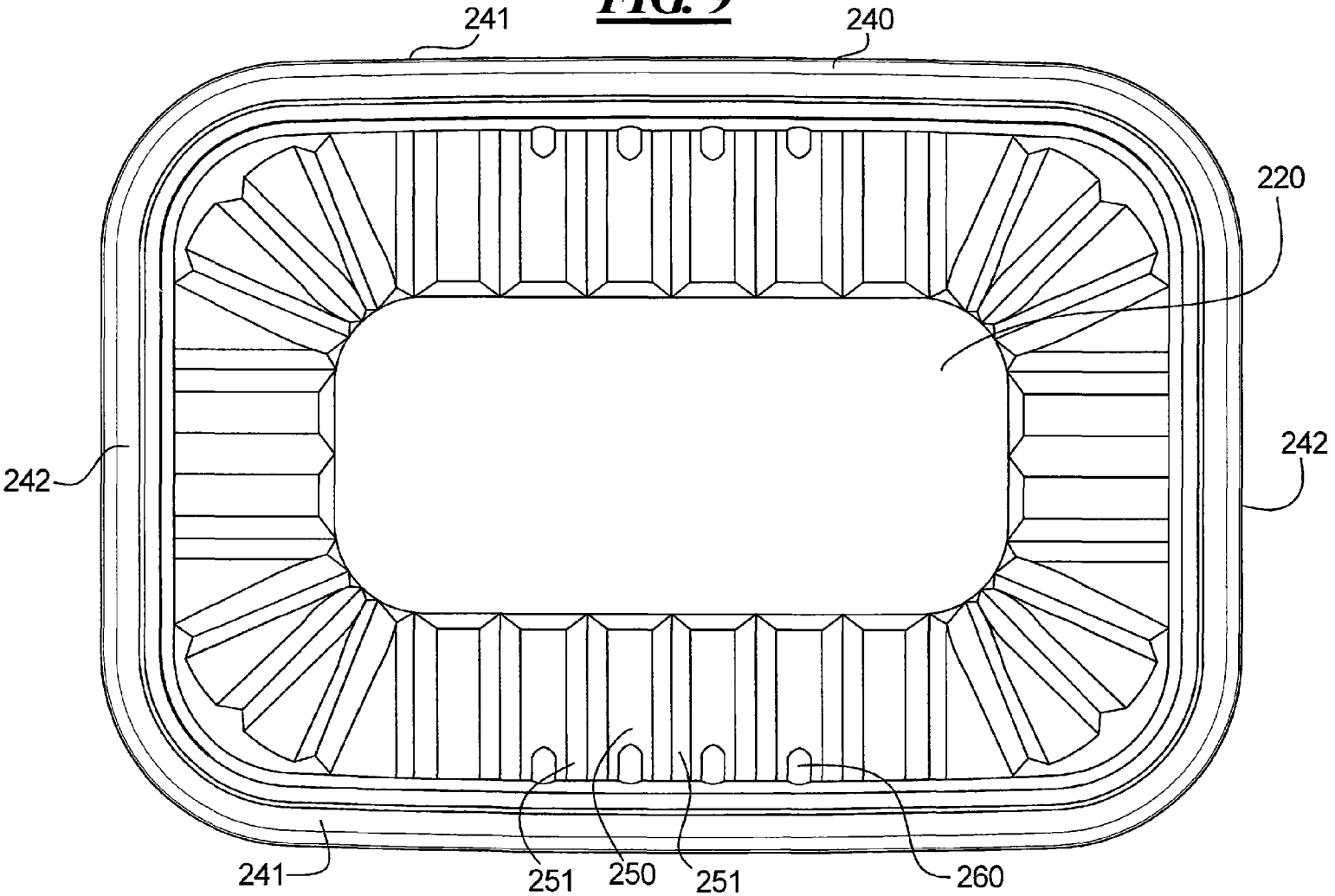
FIG. 9 is a top view of the container shown in FIGS. 6-8.

To further improve the load resistance and anti-buckling performance of the container 200, each of the sidewalls 231 include a plurality of ribs 250 extending between its upper and lower ends (233, 234). Each of the ribs 250 is defined by two adjacent grooves 251 provided on the sidewalls 231. Again, the ribs 250 and grooves 251 of the container 200 upwardly terminate into the top rim 240. As illustrated in FIG. 8, the end walls 232 may also include a plurality of ribs 250 defined by adjacent grooves 251, both of which terminate into the top rim 240. However, as the end walls 232 may be less susceptible to load-induced deformation and buckling, the ribs 250 and grooves 251 on the end walls 232 may be optional in other examples.

Figure 6:
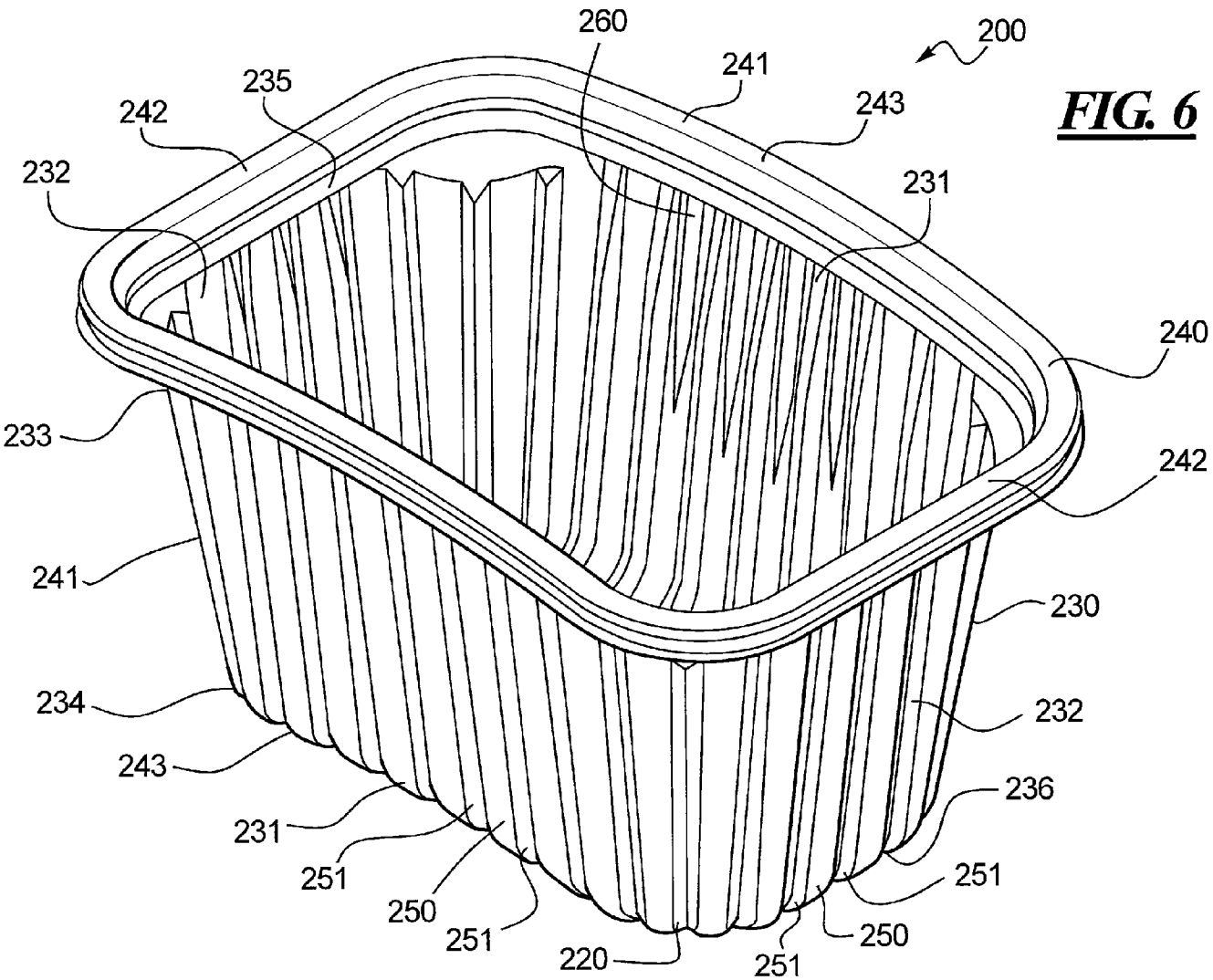
FIG. 6 is a top perspective view of a container according to another exemplary embodiment of this disclosure.
Figure 7:
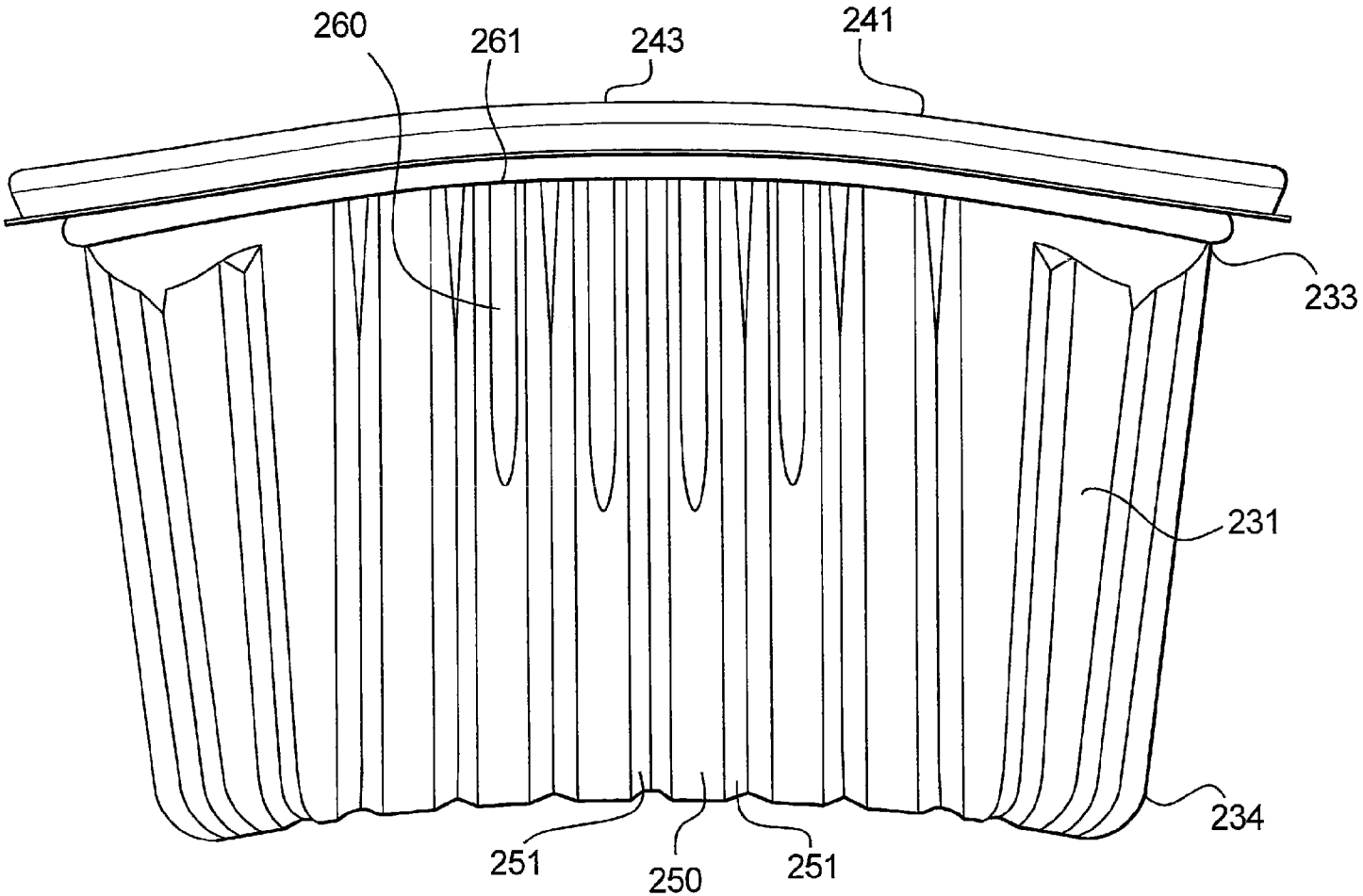
FIG. 7 is a side view of the container shown in FIG. 6.

As illustrated in FIGS. 6-7, the sidewalls 231 may include at least one reinforcement protrusion 260 to further improve the load resistance and anti-buckling performance of the container 200. The protrusion 260 has a geometric center that is disposed on the upper half (i.e. above the horizontal center line) of the sidewall 231. In some non-limiting examples, the entire protrusion 260 may be disposed on the upper half of the sidewall 231. As illustrated in FIGS. 6-9, the protrusion 260 may upwardly terminate into the top rim 240, although it may upwardly terminate below the top rim 240 in other embodiments. The protrusion 260 may be provided on one of the ribs 250 as shown in FIGS. 6-7, or it may be provided on one of the grooves 251 or between the rib 250 and adjacent groove 151 (not shown). The protrusion 260 may have an elongated triangular shape with its base 261 merged into the top rim 240 of the container 200. Other shapes, however, may also be used in light of this disclosure. For example, the protrusion 260 may be rectangular, diamond-shaped, oval, or other suitable elongated shapes. The protrusion 260 may be narrower than the rib 250, the groove 251, or both, although wider and larger protrusions may also be used in light of this disclosure.

To evaluate the anti-buckling performance of the containers (10, 100, 200), Finite Element Analysis (FEA) was used to model and calculate the container's maximum load, maximum wall displacement under the maximum load, and buckling load. The FEA of the exemplary containers was performed by Emergent Systems, 3 Parklane Blvd, Suite 1120 West, Dearborn, Mich. 48126, using ANSYS® software. For comparison purposes, the containers (10, 100, 200) all had substantially similar wall thickness profiles, dimensions, and weights.

As the exemplary containers can be divided into four quarter sections through two imaginary perpendicular vertical planes, the buckling load of the container may be calculated through the following steps: (1) for each quarter section of the container, calculating the stress $S_{10N}$ (MPa) developed in the container when an arbitrary load of 10 N is applied to the top quarter rim of the container; (2) assuming a linear relationship between the load and stress, calculating the maximum load of the quarter section under maximum stress $S_{max}$, i.e. the yield strength of the container material (for polypropylene $S_{max}$=33 MPa); and (3) multiple the maximum load of the quarter section by four to obtain the maximum load of the container $L_{max}$ (lbs). Once the maximum load is determined, buckling load $L_{buckling}$ (lbs) may be calculated by multiplying the maximum load $L_{max}$ (lbs) by a buckling factor obtained through the FEA modeling. Without wishing to be bound by any particular theory, it is contemplated that the buckling factor and buckling load may be used to characterize the anti-buckling performance of the container, with higher buckling factors and buckling loads indicating better anti-buckling performance. Following the above-described procedure, the buckling factor and buckling load of the containers (10, 100, 200) were calculated and are listed in the table below:

TABLE 1

Anti-Buckling Performance of the Containers

| Container | Container 10 | Container 100 | Container 200 |
|---|---|---|---|
| Buckling Factor | 0.2678 | 0.6162 | 1.374 |
| $L_{buckling}$ (lbs) | 2.38 | 5.354 | 5.413 |

As indicated in Table 1, the reinforcement protrusion on the sidewall of the container 100 significantly improved the anti-buckling performance of the container 100. Specifically, when container 100 is compared with the container 10, which is similar to container 100 but does not include the reinforcement protrusions, the buckling load of the container 100 is increased by at least 100% as a result of the reinforcement protrusions. Further, the non-planar top rim profile significantly improves the anti-buckling performance of the container 200. In particular, when container 200 is compared with the container 100, the buckling factor of the container 200 is increased by at least 100% as a result of such a top rim profile, which leads to a further improved buckling load despite a decrease in the maximum load of the container 200.

The container disclosed herein may be made of thermoplastic materials such as polyolefins or polyesters. For example, the container may be made of polyethylene, polypropylene, polyethylene terephthalate, or the like. However, other polymeric materials, inorganic materials, metallic materials, or composites or laminates thereof may also be used. Further, the materials used in the disclosed containers may be natural or synthetic.

While only certain exemplary embodiments have been set forth, alternative embodiments and various modifications will be apparent from the above descriptions to those skilled in the art. These and other alternatives are considered equivalents and within the spirit and scope of this disclosure.

What is claimed is:

1. A container, comprising:

a bottom wall;

opposing sidewalls each including a plurality of ribs; and opposing end walls interconnecting the sidewalls, each of the sidewalls including a plurality of inwardly facing reinforcement protrusions each being disposed on one of the ribs and each being disposed entirely on the upper half of the sidewall;

wherein the thickness of the sidewall increases from an upper end to a lower end of the sidewall; and wherein each reinforcement protrusion upwardly terminates into the upper end of the sidewall.

2. The container of claim 1, wherein the end walls are horizontally shorter than the sidewalls.

3. The container of claim 1, wherein the container is formed of a thermoplastic material.

4. The container of claim 1, wherein the sidewalls and end walls are upwardly and outwardly extending from the bottom wall.

5. The container of claim 4, wherein the sidewalls upwardly terminate into substantially parallel curved edges with raised center portions.

6. The container of claim 5, wherein the end walls upwardly terminate into substantially parallel straight edges interconnecting the two curved edges.

7. A container, comprising:

a bottom wall;

opposing sidewalls each upwardly extending from the bottom wall and terminating into a side edge, and each sidewall having a plurality of vertically disposed ribs;

opposing end walls each upwardly extending from the bottom wall and terminating into an end edge, the side edges being non-planar; and a plurality of inwardly facing vertically disposed reinforcement protrusions each being disposed entirely on the upper half of the container wall, and each reinforcement protrusion being disposed on one of the ribs;

wherein a thickness of each sidewall increases from an upper end to a lower end of the sidewall; and wherein each reinforcement protrusion upwardly terminates into the upper end of the sidewall.

8. The container of claim 7, wherein the side edges each comprise an upwardly raised center portion.

9. The container of claim 7, wherein each sidewall includes a plurality of ribs, not all the ribs having a protrusion disposed thereon.

10. The container of claim 7, wherein the container is substantially rectangular.

11. The container of claim 7, wherein the container is formed of a thermoplastic material.

12. The container of claim 7, wherein the side edges comprise substantially parallel curved edges with raised center portions, and the end edges comprise substantially parallel straight edges interconnecting the curved edges.

13. A container comprising:

a bottom wall; and a continuous container wall upwardly extending from the bottom wall and terminating into a top rim, the container wall including a plurality of ribs; and a plurality of inwardly facing non-circumferential reinforcement protrusions each being disposed on one of the plurality of ribs and each being disposed entirely on the upper half of the container wall, the top rim of the container wall being non-planar;

wherein a thickness of the container wall increases from top to bottom; and wherein each reinforcement protrusion upwardly terminates into the top rim.

14. The container of claim 13, wherein the top rim comprises two substantially parallel curved edges with raised center portions, and two substantially parallel straight edges interconnecting the two curved edges.

15. The container of claim 13, wherein the container is substantially rectangular.

16. The container of claim 13, wherein the container is formed of a thermoplastic material.

17. The container of claim 13, wherein each of the ribs and protrusions is non-perforated.

18. The container of claim 17, wherein only some of the plurality of ribs have protrusions disposed thereon.

* * * * *